US007784551B2

(12) United States Patent
Angman et al.

(10) Patent No.: US 7,784,551 B2
(45) Date of Patent: Aug. 31, 2010

(54) TUBULAR HANDLING DEVICE

(75) Inventors: Per G. Angman, Calgary (CA); Bruno H. Walter, St. Albert (CA); Svatomira Walter, legal representative, St. Albert (CA); Bronislav Walter, Edmonton (CA)

(73) Assignee: Tesco Corporation, Houston, TX (US)

( * ) Notice: Subject to any disclaimer, the term of this patent is extended or adjusted under 35 U.S.C. 154(b) by 205 days.

(21) Appl. No.: 12/020,349

(22) Filed: Jan. 25, 2008

(65) Prior Publication Data

US 2008/0210439 A1 Sep. 4, 2008

Related U.S. Application Data

(60) Provisional application No. 60/886,584, filed on Jan. 25, 2007.

(51) Int. Cl.
*E21B 23/01* (2006.01)

(52) U.S. Cl. ..... 166/382; 166/208; 166/380

(58) Field of Classification Search ... 166/77.51–77.53, 166/85.1; 411/535, 536, 149, 1
See application file for complete search history.

(56) References Cited

U.S. PATENT DOCUMENTS

| | | | | |
|---|---|---|---|---|
| 1,777,591 | A | 10/1930 | Thomas | |
| 2,455,658 | A * | 12/1948 | Dons et al. | 138/94.3 |
| 3,301,567 | A * | 1/1967 | Barr | 277/621 |
| 6,311,792 | B1 | 11/2001 | Scott et al. | |
| 6,742,584 | B1 * | 6/2004 | Appleton | 166/98 |
| 6,742,596 | B2 | 6/2004 | Haugen | |

* cited by examiner

*Primary Examiner*—David J. Bagnell
*Assistant Examiner*—James G Sayre
(74) *Attorney, Agent, or Firm*—Bracewell & Giuliani LLP

(57) ABSTRACT

A device for handling well pipe includes a mandrel including an upper end, a lower end and a long axis extending between through the upper end and the lower end. The mandrel secures to a top drive of a drilling rig. A threaded collar is located on an outer surface of the mandrel to loosely engage threads of a well pipe. An annular force generating assembly is carried on the mandrel and positioned between the upper end and the threaded collar. The force generating assembly applies a load to an upper end of the well pipe along the long axis, enabling torque to be transmitted between the threaded collar and the well pipe. The force generating assembly may be cams or a hydraulic piston.

21 Claims, 4 Drawing Sheets

TUBULAR HANDLING DEVICE

CROSS REFERENCE TO RELATED APPLICATIONS

This application claims priority to U.S. provisional application No. 60/886,584, filed Jan. 1, 2007.

FIELD

This invention relates to a tubular gripping device for wellbore operations and, in particular, a device for gripping and manipulating oilfield tubulars during drilling and/or completion of a well.

BACKGROUND

A tubular gripping device may be used to engage and manipulate a tubular during wellbore operations. Generally, a tubular gripping device is installed in a drill rig during drilling and/or completing a wellbore to grip and move the tubulars being run in or tripped out of a wellbore. Some common oilfield tubulars include, for example, casing, including various forms of wellbore liners, and drill pipe. Such tubulars often include a threaded box end. As will be appreciated, in general drill pipe is formed with an integral threaded box end, while a joint of casing is generally used with a coupling installed on a pin end thereof. The coupling generally has two threaded box ends, one of which is threaded onto the casing joint and the other of which remains open for threaded engagement with another casing joint when forming a casing string.

It is common practice to mount a tubular gripping device on a drive apparatus such as a top drive or other torque generating device suspended above hole center in order to impart rotational and axial drive to the tubular gripping device. Some gripping devices for oilfield tubulars, for example, are described in U.S. Pat. No. 6,311,792, issued November, 2001 and U.S. Pat. No. 6,742,584, issued June, 2004, both to TESCO Corporation.

While such tubular gripping devices are useful, some operations may best be served by avoiding the use of gripping devices with slips, which may mark the wall of the tubular.

SUMMARY

In accordance with one aspect of the invention, there is provided a tubular gripping device comprising: a mandrel including an upper end, a lower end and a long axis extending between through the upper end and the lower end; a threaded interval on an outer surface of the mandrel; and a force generating assembly carried on the mandrel and positioned between the upper end and the threaded interval adjacent the threaded interval and driveable to apply a load along the long axis toward the threaded interval.

In accordance with another aspect of the present invention, there is provided a method for handling a wellbore tubular including a threaded box end, the method comprising: providing a tubular gripping device supported in a drill rig, the tubular gripping device including a mandrel carrying a threaded interval; threading the threaded interval into engagement with a tubular to be handled; applying a force on the tubular to cause closer engagement between the threaded interval and the tubular; and manipulating the tubular by movement of the tubular gripping device.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

Figure 1:
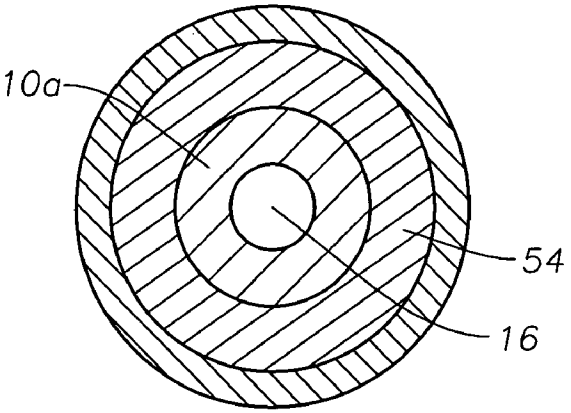
FIG. 1 is an elevation of an upper end of one embodiment of a tubular gripping device.

The description that follows, and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

Figure 2:
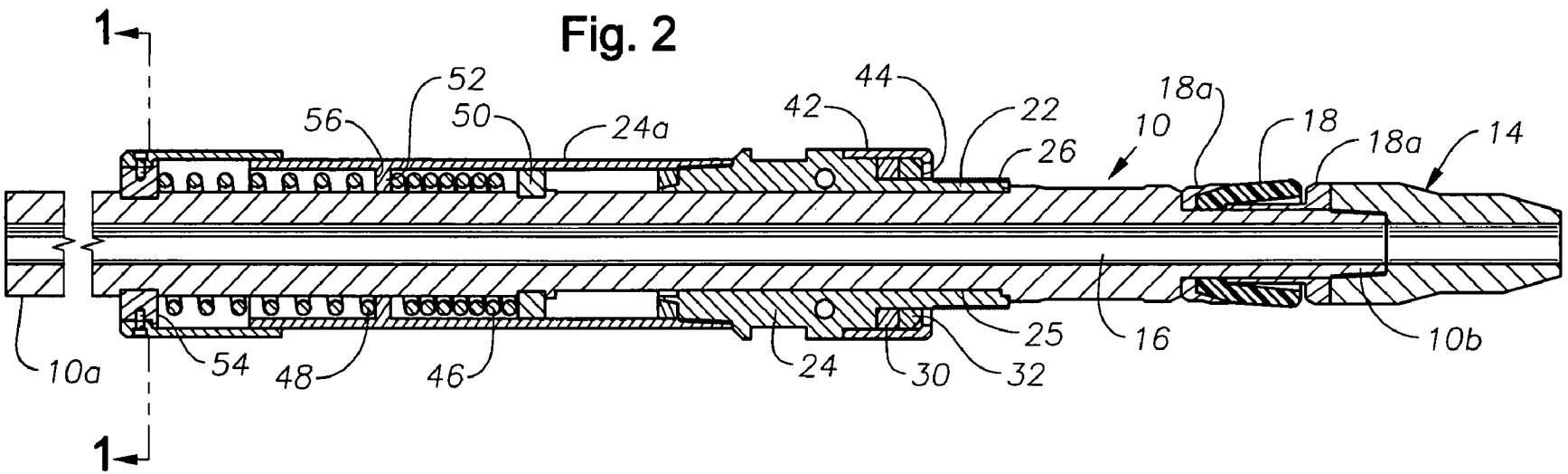
FIG. 2 is an axial section along line A-A of FIG. 1.
Figure 3:
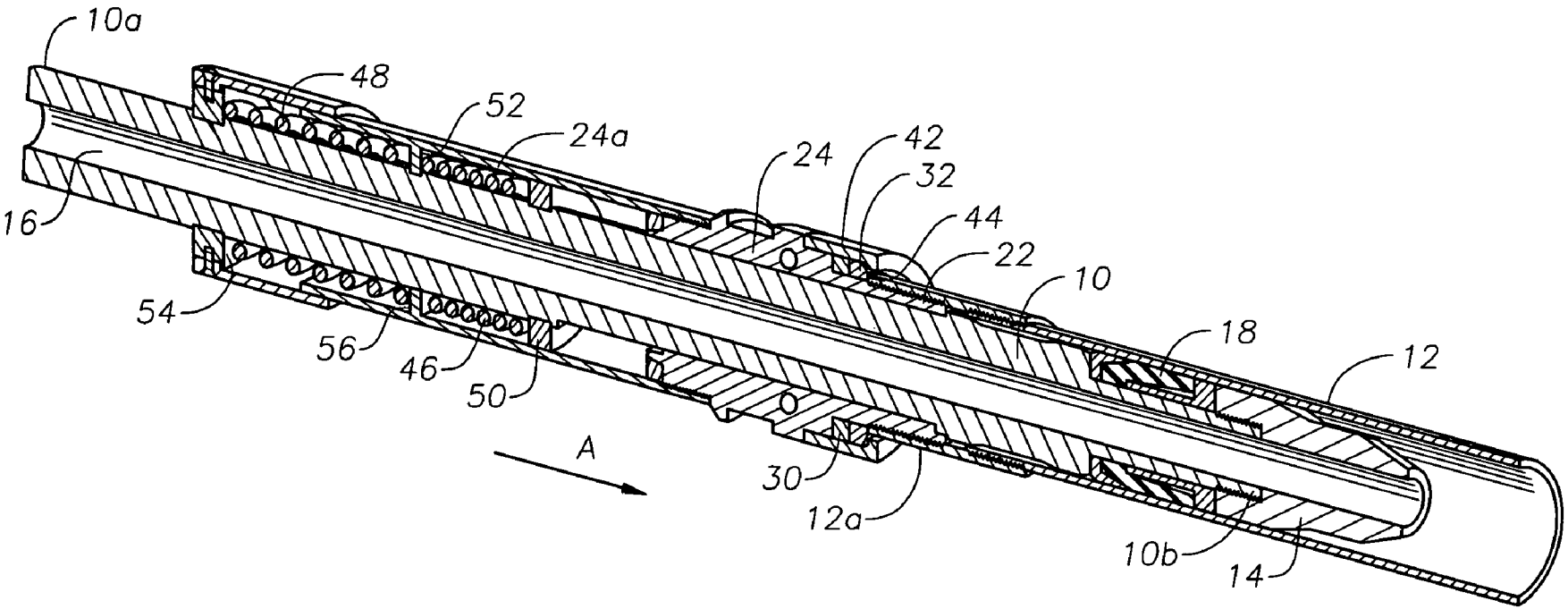
FIG. 3 is a perspective view of the tubular gripping device of FIG. 1, shown partly in an axial section, and engaging a tubular.

With reference to FIGS. 1 to 3, a tubular gripping device according to one aspect of the present invention includes a mandrel 10 for inserting, lower end first, into the inner diameter of a tubular 12, such as for example a joint of casing as shown. An upper end 10*a* of the mandrel is formed to be held in a drill rig. For example, upper end 10*a* of the mandrel may be threaded or otherwise formed for engagement to the quill of a drive apparatus such as a top drive (not shown). By securing the mandrel to the quill, rotational drive may be imparted from the top drive to the mandrel. In addition, by such connection, the mandrel may be moved axially over hole center and laterally with the top drive about the drill rig, as by use of torque tracks, extension arms, and draw works.

Lower end 10*b* of the mandrel may include a nose 14, secured thereto (as shown) or formed integral therewith, which may include a tapered end and/or an elastomeric surface to facilitate and to mitigate damage caused by impact during insertion into tubular 12.

The mandrel may further include an axial bore 16 for circulation therethrough. Bore 16 may extend from upper end 10*a* through nose 14 such that fluid can be conveyed from the quill into any tubular held by the gripping device. Fluid circulation may, therefore, be maintained through the well during tubular handling. Also or alternately, an annular seal 18 may be positioned about the mandrel to provide a sealing element between the mandrel and an inner wall of tubular 12 being handled. In the illustrated embodiment, packer cup keepers 18*a* may be used, as shown, to retain the annular seal on the mandrel.

The tubular gripping device further includes a tubular engagement mechanism on the mandrel. The tubular engagement mechanism acts in part by threaded engagement between the tubular gripping device and a threaded box 12*a* of a tubular to be handled. In the presently illustrated embodiment, the tubular engagement apparatus includes a male threaded interval 22, the size and thread form of which is selected to be capable of threaded engagement with the threaded box of the type of tubular intended to be handled. Such threaded engagement may be that which prevents the parts from being pulled axially apart after making up the connection, for example which may support the hook load. The thread form selected for threaded interval 22 may be that intended for close tolerance engagement with the thread form of the tubular to be handled. However, it will be appreciated that normal connections using close tolerance thread forms, such as tapering, buttress and 8-round connections can be so close that the threads to some degree tend to deform and jam together. Thus, if it is desired to avoid damaging the thread of the tubular being handled, the threaded interval may include a modified thread form from that of the tubular being handled. The modified thread form may be selected to avoid damaging the threads of the tubular being handled and to facilitate make up of the threaded connection between the parts. Also, it is noted that the threaded connection may not need to hold pressure (due to the use of annular seal 18). As such, the thread form of threaded interval 22 may be selected to be modified to only loosely engage with the threads of the tubular. In one embodiment, for example, threaded interval 22 may include threads with a form similar to that of the tubular being handled but with a major, minor and/or pitch diameter less than that of the tubular being handled. Alternately, the threaded interval may be provided with a thread profile modified from that of the tubular to be handled such as, where the tubular to be handled has a buttress type thread, the threaded interval can be formed with a buttress form on one flank and a rounded form on the opposite thread flank. In the illustrated embodiment, the threaded interval includes a continuous thread form with the interval itself being circumferentially complete. While, the threaded interval need not be continuous about a full circumference of the pin, it may be useful to form sections of the pin end such that they together define a final frustoconical form that tends to have a substantially uniform engagement about the circumference of the box end of a well bore tubular. Further, it may be useful to form the threaded interval such that the thread form groove, whether continuous or interrupted by gaps, extends in an aligned helix along the full interval such that the threads of the threaded interval fit smoothly into the threads of the tubular's box end, this to avoid damaging the threads of the tubular.

As will be appreciated during wellbore operations, tubular 12 to be handled may generally be held stationary in the rig and the threaded interval 22 may be driven to rotate to thread into the threaded box of the tubular. Rotation of the threaded interval may be driven by rotation of mandrel 10 on which the threaded interval is carried. Once threaded into the box end, threaded interval engages the tubular and any weight thereof or a string attached therebelow can be transferred through the threads to the mandrel and therethrough to the quill and top drive. Further, any movement of the quill and top drive, axially, rotationally and laterally, can be transferred through the mandrel to the tubular secured on the threaded interval.

Threaded interval 22 may be formed into the material of mandrel 10. Alternately, threaded interval 22 may be formed on a separate part and mounted on the mandrel. For example, as shown in the presently illustrated embodiment, threaded interval 22 may be formed on a collar 24, which is mounted on the mandrel. Collar 24 may be substantially rotationally fixed relative to the mandrel such that any rotational movement of the mandrel is communicated to the collar. In the illustrated embodiment, collar 24 is installed annularly about mandrel and the mandrel and the threaded collar may include thereon interlocking splines/grooves 25, a faceted region, a key and keyway arrangement, etc. to lock the parts together rotationally. Collar 24 may further be installed to affect a load transfer to mandrel. For example, the weight of one or more tubulars may be carried on the threaded interval and collar and such weight must be transferred to the mandrel. As such, the collar is firmly secured against axial sliding off end 10*b* of the mandrel. In the illustrated embodiment, for example, mandrel 10 includes a shoulder 26 against which the bottom end of collar 24 abuts to limit downward movement thereof along the mandrel. Shoulder 26 creates a load path from the collar into the mandrel. Shoulder 26 may be formed into the material of the mandrel, as shown, or may be formed by building up the material about the mandrel as by securing (i.e. welding, fusing, threading, etc.) a ring or other material to increase the OD of the mandrel below the collar.

Tubular engagement mechanism may further include a mechanism for applying a load to the tubular when it is secured on the threaded interval to increase the torque capacity of the any threaded connection between the tubular and the threaded interval without having to fully torque up the connection up. For example, an axially directed load may be applied to shift the tubular axially relative to the threaded interval, which may cause the threads to bite into one another, stabilize the threaded connection between the tubular and the threaded interval and increase engagement therebetween to increase the ability to transmit torque through the interengaged threads. A force generating assembly may therefore be provided to bear against a tubular engaged on the threaded interval to cause the threads of the tubular to be brought into closer engagement with the threads of the tubular. The force generating assembly may include a device carried on the mandrel and positioned adjacent the threaded interval to be capable of being brought into contact with any tubular threaded onto the threaded interval. The device may include a contact surface adjacent the threaded interval, that can be brought into contact with the tubular, either by moving the contact surface along the tool or by positioning the contact surface such that a tubular can be threaded along the threaded interval into contact with the contact surface, and through which a force can be applied to the tubular. The contact surface may present a shoulder that protrudes out adjacent the base of the threaded interval. The force generating assembly may be configured to apply an axially directed force that is distributed substantially concentrically about the long axis of the mandrel such that the tubular substantially moves axially. As such, the contact surface may form a substantially annular structure about the mandrel and having a plane of contact substantially orthogonal to the mandrel axis.

In one embodiment, the force generating assembly may include a cam assembly provided adjacent to the base of the threaded interval which will be uphole from threaded interval 22. The cam assembly may employ the relative rotation which is inherent during threading between the tubular and the threaded interval to drive the tubular axially relative to the threads of the threaded interval to drive the threads into closer contact.

Figure 5:
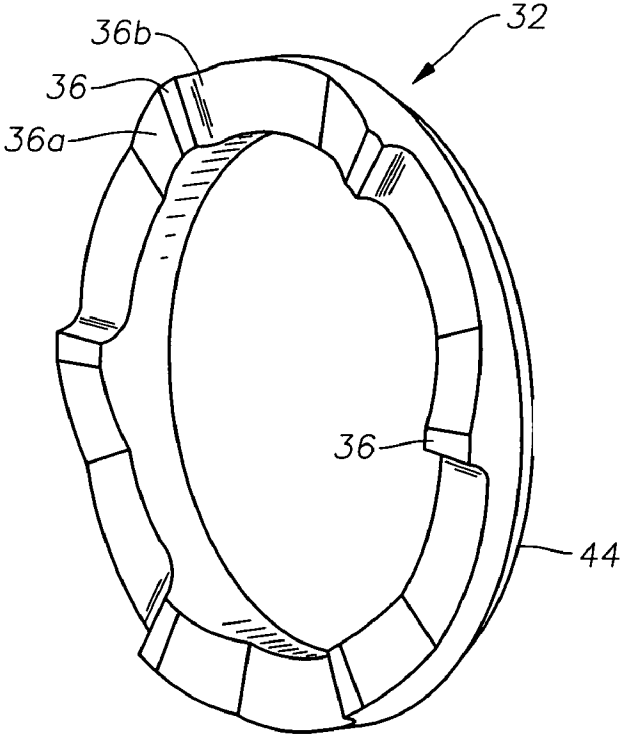
FIG. 5 is a rear perspective view of a floating cam ring.
Figure 4:
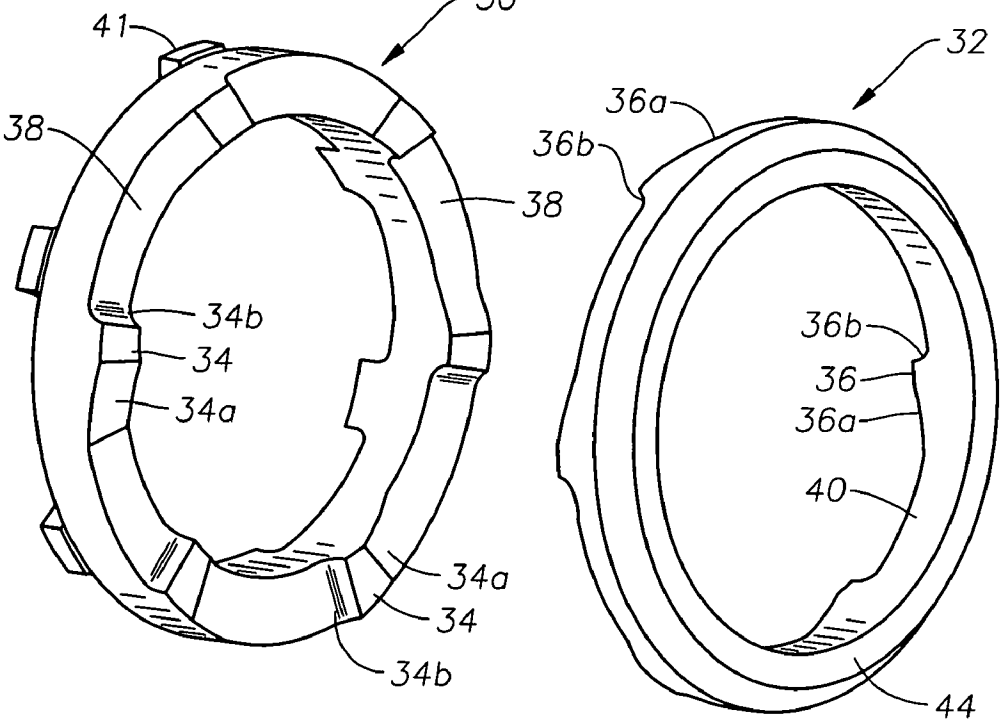
FIG. 4 is a perspective view of a floating cam ring and an upper cam ring useful in the present invention.

With reference also to FIGS. 4 and 5, for example, the cam assembly in one embodiment includes a base cam ring 30 and a floating cam ring 32, both substantially axially aligned and annularly positioned about the mandrel. The cam rings are correspondingly formed having interacting cam surfaces with undulations such that in one relative rotational configuration, the rings fit together to define a first combined length and in a second relative rotational configuration, floating ring 32 is forced axially away from base cam ring 30 by the interacting surfaces thereof to define a second combined length greater than the first combined length. In the illustrated embodiment, for example, rings 30, 32 may each include camming protrusions 34, 36, respectively, on their facing surfaces. In one embodiment, the ring protrusions on at least one side, protrusions 34, for example, are spaced apart circumferentially on the ring, leaving a recessed area 38 therebetween and include a ramped surface 34*a* on at least side transitioning from the recessed area to the high point of each protrusion. Where each protrusion includes only one ramped surface, the ramped surfaces for the plurality of protrusions are each positioned on the same side, clockwise or counterclockwise, relative to their protrusion. The protrusions on the opposite ring, protrusions 36, for example, are positioned to face the protrusions of the other ring, include recessed areas 40 therebetween, and are spaced in a configuration substantially similar with the protrusions of the opposite ring such that together they operate as a cam assembly. For example, with the protrusions 34, 36 similarly circumferentially positioned, the rings, during relative rotation therebetween, can move between a neutral position wherein their protrusions each fit into a valley on the opposite ring and a driven position wherein their protrusions are driven over and are biased against each other, forcing the rings apart. Of course, only the protrusions on one ring require ramped surfaces in order to allow the other ring's protrusions to ride up thereover. However, in the illustrated embodiment the protrusions on both rings include ramped surfaces 34*a*, 36*a*, respectively, adjacent their protrusions to smooth their interaction. As will be appreciated, where both rings include ramped surfaces, the ramped surfaces on one ring will be positioned on the opposite, clockwise or counterclockwise, side of the protrusions on the other ring, such that as the rings rotate relative to each other, the ramped surfaces can ride up over each other pushing the rings apart.

Base cam ring 30 may be substantially fixed to rotate with the threaded interval. For example in the illustrated embodiment of FIGS. 1 to 5, base cam ring 30 has a keyed rear surface 41 that engages in notches formed in a body connected to or integral with collar 24. Floating cam ring 32 is retained by housing 42 adjacent ring 30 but may rotate at least in one direction about the mandrel, for example counterclockwise when viewed from the top of the mandrel, and can rotate in the opposite direction, for example clockwise, to a limited degree. The cam ring assembly may include protrusions with ramped surfaces on one side and stops on the other, such as by forming a side of at least some of the protrusions opposite ramps 34*a*, 36*a* with a shoulder 34*b*, 36*b* having an abrupt height change, in order to limit the degree of rotation of the floating cam ring. In particular, by use of shoulders 34*b*, 36*b*, floating ring 32 may rotate only until the shoulders come into contact and stop any further rotation.

Floating cam ring 32 may be mounted such that during operation of the tubular gripping device it can be engaged by the tubular being installed on the threaded interval. In the illustrated embodiment, for example, housing 42 surrounds ring 32 but leaves an annular opening through which an end 44 of ring is exposed for contact. Floating cam ring 32 is, therefore, exposed and spaced relative to threaded interval 22 to be engaged by a tubular 12 being threaded onto the interval. For example, end 44 may be positioned such that the box end of a tubular contacts it when the threaded interval is almost fully tightened into the box of the tubular. End 44 is formed to be firmly engaged by the tubular when they come into contact. In some embodiments, engagement may be enhanced as by forming end 44 of an elastomeric material, roughening the surface of end 44, etc.

Base cam ring 30 rotates with the threaded interval and when floating cam ring 32 becomes engaged by the tubular, base cam ring 30 will be driven to rotate relative to the floating cam ring, as the floating cam ring is held by the tubular against rotation. The cam ring assembly may be selected and positioned such that when the tubular is threaded onto the collar sufficiently to have threaded engagement therebetween, the floating cam ring becomes jammed between the base cam ring and tubular 12. Jamming, for example, may occur by interaction of the camming surfaces of the rings. As the camming protrusions 34, 36 begin to ride up over each, the rings are forced apart increasing their effective combined length. Thus, when the rings become jammed together, the rings of the cam ring assembly are held in this position and apply an axial load along arrow A against the tubular, causing the tubular's threads to bite firmly, and lock up, against the threads of the threaded interval. In this condition, the tubular is held firmly on mandrel 10 and can be manipulated in the drill rig. In addition, torque can be readily transmitted from the mandrel to the tubular such that the tubular can be rotated in the direction that reinforces the jamming action, which in the illustrated embodiment is in a right hand (clockwise) direction, by rotation of the mandrel, thus permitting the engaged tubular to be threaded at its opposite end to a second tubular, for example, which may be held in the drill floor.

It is desirable to apply the axially load prior to the connection being fully torqued up. As will be appreciated, therefore, sufficient room must be provided in the connection between the threaded interval and the tubular to allow the parts to shift axially. As such, if the connection includes a torque shoulder in the box, the cam ring assembly and threaded interval may be formed and/or relatively positioned and spaced to allow the floating cam ring to lock up against the end face of the tubular box prior to the threaded interval pin end shouldering up against the connections torque shoulder.

To release the jammed condition created by the cam rings, the mandrel may be rotated in a direction that releases the camming surface protrusions 34, 36 from engagement. In the illustrated embodiment, rotation of the mandrel in the left hand direction, when viewed from above, relative to the tubular engaged on the threaded interval acts to disengage the camming surfaces of the rings 30, 32. Left hand rotation of mandrel relative to the tubular causes the base cam ring to rotate back, while the floating cam ring is held by the tubular against rotation such that protrusions 34 slide back off protrusions 36. As the protrusions become disengaged, the rings to fit together with the protrusions on one ring positioned in the recesses of the other and the combined length of the rings becomes reduced. This then removes the axial load from the tubular and allows the threaded connection between the threaded interval and the tubular to be easily broken out.

Continued rotation of the base ring relative to floating ring 32 causes shoulders 34*b*, 36*b* to come into contact to cause ring 32 to move with ring 30 and to pull floating ring 32 out of engagement with the tubular, if necessary.

In one embodiment, threaded interval 22 may be axially moveable along a portion of the length of mandrel 10 such that it can be withdrawn from a threaded connection to the tubular without requiring axial movement of either the mandrel or the tubular. In one possible embodiment, for example, collar 24 is axially moveable along the mandrel and may be biased in an upward direction towards upper end 10*a* of the mandrel but may be urged axially downwardly by application of force. For example, a spring 46 may be positioned to act between collar 24 and the mandrel to bias the collar upwardly, away from end 10*b*, on the mandrel but to permit the threaded collar to be drawn down the mandrel toward end 10*b*, by application of force against the force of spring 46. In operation for example, where it is desired to break out a threaded connection between threaded interval 22 on the collar and a tubular, while the collar is threaded into the tubular box, the mandrel may be raised to force collar 24 against the force of spring 46 and then the mandrel can be rotated to unthread the collar from the tubular box. As the threaded collar is rotated to unthread from the box, the bias in spring 46 will cause the threaded collar to be withdrawn from the tubular, without also requiring axial separation of the mandrel and the tubular.

In another embodiment, alternately or in addition to the biasing of the threaded interval upwardly on the mandrel, threaded interval 22 may be biased downwardly on the mandrel to assist with the advancement of the threaded interval into the tubular box during a threading operation. For example, a spring 48 may be provided between collar 24 and mandrel 10 to bias the threaded collar downwardly toward end 10*b* on the mandrel.

It will be appreciated that the threaded collar may be biased into a selected position but capable of movement, as required, upwardly or downwardly on the mandrel by use of various means, such as two springs acting against each other or one double acting spring capable of applying a degree of force in both directions. In the illustrated embodiment for example, first spring 46 is positioned between a stop 50 mounted on mandrel and a stop 52 mounted on an extension 24*a* of the threaded collar and second spring 48 is positioned between a stop 54 on the mandrel and a stop 56 on an extension on the threaded collar. While the illustrated tool shows the springs axially spaced, of course the springs can be nested. Again, a double acting spring or other biasing device, such as a hydraulic damping means or an elastomeric insert can be used, as desired.

One or both of an upward or downwardly acting biasing force of the threaded collar on the mandrel may also be useful to provide a shock absorber action.

In one embodiment, the collar may be biased against load shoulder 26 in a neutral position. In such an embodiment, the force in spring 48 may be greater than the biasing force of spring 46.

Figure 6:
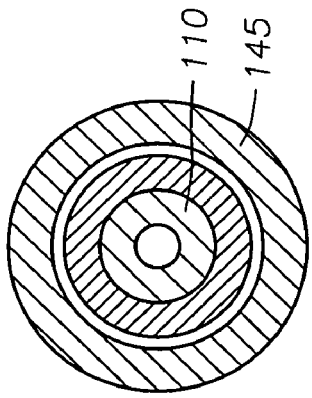
FIG. 6 is an end view of another embodiment of a tubular gripping device according to the present invention.
Figure 7:
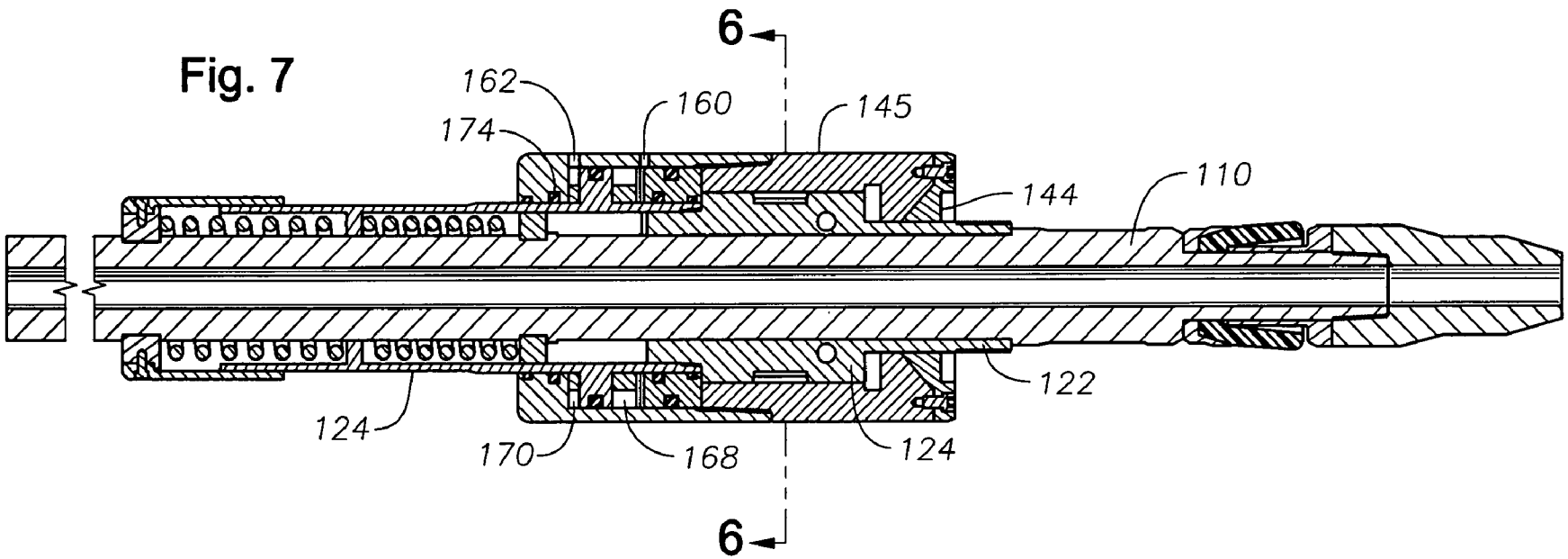
FIG. 7 is an axial section along line A1-A1 of FIG. 6.

Referring to FIGS. 6 and 7, another embodiment of a tool is shown. In this illustrated embodiment, the axial load is provided by a hydraulic drive rather than a cam assembly. For example, a contact surface 144 is positioned for contact with an end of a tubular to be threaded onto threaded interval 122. Contact surface 144 is connected to a housing 145 for rotational and axial movement therewith. Housing 145 is mounted about a collar 124 on which threaded interval 122 is formed. Collar 124 is connected to move rotationally with a mandrel 110 of the gripping device.

This tool is hydraulically actuated to allow housing 145 and, thereby, contact surface 144 to be driven axially relative to threaded interval 122. For example, a system of hydraulic chambers may be provided between housing 145 and collar 124. The hydraulic chambers may include a drive chamber 168 fed through hydraulic port 160, which can be pressurized by pressurized by a fluid including any of oil, air, other gases, etc. to drive housing 124 and contact surface 144 toward threaded interval 122 and a release chamber 170 fed through port 162, which can be pressurized to move the housing axially back away from the threaded interval. During operation, threaded interval 122 may be threaded into a tubular to be handled and a hydraulic force may be applied through port 160 to a chamber 168 to drive housing 145 axially down toward the threaded interval, which applies an axial load through contact surface 144 to a tubular threaded on interval 122. The tubular can then be manipulated, as by transmitting torque from the mandrel, to the collar and through the threaded connection to the tubular. The axial load can be removed by releasing the hydraulic pressure from locking chamber 168 and possibly pressurizing release chamber 170 to drive housing 145 back over collar 124. This movement thereby positively retracts the contact surface 144 in a direction away from the threaded pin 122 of collar 124 to remove the axial load from any tubular engaged thereon.

Since the illustrated embodiment requires the connection of hydraulic hoses at ports 160, 162, it may be useful to form housing 145, at least in a portion about the ports to be isolated from the rotation of the mandrel. For example, a connection may be provided between housing 145 and the housing of the top drive, to maintain the tool housing in a stationary position, while the mandrel and collar rotate therein. A rotary seal arrangement, shown in part at 174, may be provided to isolate the housing from the collar, while maintaining the integrity of the hydraulic system.

While the embodiment of FIGS. 1 to 3 may be useful to operate to apply torque in one direction, it cannot be used to apply torque in the opposite direction. Thus, a power tong may be required to trip out a tubular string that was tripped in with the present device. However, the embodiment of FIGS. 5 and 6 with the hydraulic chamber system for applying the axial load to a tubular being handled may lock the axial load between the threaded interval and any tubular threaded thereon such that torque may be applied in both clockwise and counterclockwise directions until the hydraulic pressure is released.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A device for making up a pipe with a string of pipe being lowered into a well, comprising:

a mandrel including an upper end for securing to a drive assembly of a drill rig for rotation therewith, a lower end for insertion into a pipe, and a long axis extending between through the upper end and the lower end;

a threaded interval on an outer surface of the mandrel for threaded engagement with a threaded upper end of the pipe; and an axial force generating assembly carried on the mandrel and having a contact surface that is positioned to engage a rim of the pipe when the pipe is in threaded engagement with the threaded interval, the contact surface being between the upper end and the threaded interval, the contact surface being axially movable relative to the threaded interval, the force generating assembly being driveable to apply a downward directed axial load through the contact surface to the rim of the pipe to more firmly secure the pipe to the threaded interval.

2. The device of claim 1 wherein the force generating assembly has a housing surrounding the mandrel and the contact surface, and wherein the housing has a lower end that defines an annular clearance for reception of the rim of the pipe.

3. The device of claim 1 wherein the thread form of the threaded interval is selected to loosely engage the threaded upper end of the pipe.

4. The device of claim 1 wherein the threaded interval transfers axial load placed thereon to the mandrel.

5. The device of claim 1 wherein the threaded interval is formed on a collar rotationally fixed to and axially moveable along the mandrel.

6. The device of claim 5 further comprising a load shoulder on the mandrel to limit axial movement of the collar toward lower end.

7. The device of claim 1 wherein the annular force generating assembly includes a camming assembly drivable by rotation of the mandrel about the long axis relative to the pipe being connected onto the threaded interval, the camming assembly being movable from a retracted position to an extended position exerting a downward force on the rim of the pipe in response to the rotation of the mandrel relative to the pipe.

8. The device of claim 7 wherein the camming assembly includes a base cam ring rotatable with the mandrel and a floating cam ring acted upon by the base cam ring, the floating cam ring serving as the contact surface to move downward relative to the threaded interval, the floating cam ring being positioned adjacent the threaded interval for engaging the rim of the pipe.

9. The device of claim 1 wherein the annular force generating assembly includes a floating cam ring encircling the mandrel and positioned between the upper end and the threaded interval, the floating cam ring serving as the contact surface to be engaged by the rim of pipe, the floating cam ring being axially drivable to apply the axial load.

10. The device of claim 1 wherein the annular force generating assembly includes a hydraulic system to drive the contact surface toward the threaded interval.

11. The device of claim 1 wherein the threaded interval is axially moveable on the mandrel and is biased toward the upper end.

12. The device of claim 1 wherein the threaded interval is axially moveable on the mandrel and is biased toward the lower end.

13. A method for making up a wellbore pipe with a string of wellbore pipe extending into a wellbore, the method comprising:

securing a mandrel carrying a threaded interval to a drive assembly of a drill rig;

threading the threaded interval into engagement with a threaded upper end of a wellbore pipe to be connected to a string of wellbore pipe;

applying a downward force on a rim of the upper end of the wellbore pipe to cause closer engagement between the threaded interval and the threaded upper end of the wellbore pipe; and engaging a lower threaded end of the wellbore pipe with an upper end of the string of wellbore pipe and rotating the mandrel with the drive assembly, which in turn rotates the wellbore pipe to make up the lower threaded end of the wellbore pipe with the string of wellbore pipe.

14. The method of claim 13 wherein applying the downward force includes driving a camming assembly to apply the force.

15. The method of claim 13 wherein applying a force includes driving a hydraulic system to apply the force.

16. The method of claim 13 wherein the threaded interval loosely engages the threaded upper end of the wellbore pipe until the downward force is exerted.

17. The method of claim 13 wherein applying the downward force causes the threaded upper end of the wellbore pipe to move downward relative to the threaded interval.

18. The method of claim 13 wherein applying the downward force occurs as a result of rotation of the mandrel relative to the wellbore pipe.

19. The method of claim 13 wherein threading the threaded interval includes biasing the threaded interval to move axially relative to the mandrel.

20. The method of claim 13 wherein after making up the wellbore pipe with the string of wellbore pipe, the method further comprises rotating the mandrel in an opposite direction to unthread the threaded interval from engagement with the wellbore pipe and wherein rotating in the opposite direction causes the axial load to be released.

21. An apparatus lining a wellbore, comprising:

a wellbore pipe for installation in a wellbore and having a threaded upper end;

a mandrel for rotation by a drive assembly of a drill rig and having upper and lower ends, the lower end being inserted into the upper end of the wellbore pipe;

a threaded interval on an exterior of the mandrel between the upper and lower ends and rotatable with the mandrel, the threaded interval being in threaded engagement with the threaded upper end of the wellbore pipe;

an annular contact member carried by and axially movable relative to the mandrel, the contact member being in abutment with a rim of the threaded upper end of the wellbore pipe; and a force generating assembly that moves the contact member downward relative to the mandrel and exerts a downward force through the contact member, the threaded upper end of the wellbore pipe and into the mandrel to more firmly secure the wellbore pipe to the mandrel.

* * * * *